US012669127B2

(12) United States Patent
Cullen et al.

(10) Patent No.: US 12,669,127 B2
(45) Date of Patent: Jun. 30, 2026

(54) BATTERY OPERATED MOLTEN METAL PUMP

(71) Applicant: PYROTEK, INC., Spokane, WA (US)

(72) Inventors: Sean Cullen, Kent, OH (US); Lennard Lutes, Copley, OH (US); Jason Tetkoskie, Cleveland Heights, OH (US)

(73) Assignee: PYROTEK, INC., Spokane, WA (US)

( * ) Notice: Subject to any disclaimer, the term of this patent is extended or adjusted under 35 U.S.C. 154(b) by 0 days.

(21) Appl. No.: 18/854,144

(22) PCT Filed: Apr. 12, 2023

(86) PCT No.: PCT/US2023/018270

§ 371 (c)(1),
(2) Date: Oct. 4, 2024

(87) PCT Pub. No.: WO2023/200834

PCT Pub. Date: Oct. 19, 2023

(65) Prior Publication Data

US 2025/0347281 A1 Nov. 13, 2025

Related U.S. Application Data

(60) Provisional application No. 63/330,151, filed on Apr. 12, 2022.

(51) Int. Cl.
*F04D 7/06* (2006.01)
*F04D 13/06* (2006.01)

(52) U.S. Cl.
CPC ..... *F04D 7/065* (2013.01); *F04D 13/068* (2013.01); *F04D 13/0693* (2013.01)

(58) Field of Classification Search
CPC ..... F04D 7/065; F04D 13/068; F04D 13/0693
See application file for complete search history.

(56) References Cited

U.S. PATENT DOCUMENTS 11,020,798 B2 * 6/2021 Cooper ..... F27D 3/14
11,358,217 B2 * 6/2022 Cooper ..... B22D 35/04
(Continued)

OTHER PUBLICATIONS

PCT International Search Report—PCT/US2023/018270 mailed Jul. 27, 2023; 3 pgs.
(Continued)

*Primary Examiner* — Hoang M Nguyen
(74) *Attorney, Agent, or Firm* — Lippes Mathias LLP

(57) ABSTRACT

A pump for transferring molten metal from a vessel, the system comprising: (a) a stationary intake tube, the stationary intake tube comprising (i) a cavity having a diameter, and being configured to direct molten metal upward through the inner cavity, (ii) a first end configured to be at least partially submerged in the molten metal in the vessel, and (iii) a second end: (b) a DC motor juxtaposed the second end: (c) a rotatable drive shaft positioned at least partially within the cavity of the stationary intake tube, the rotatable drive shaft having a first end connected to the motor and a second end: (d) a rotor positioned at least partially in the cavity at the first end of the stationary intake tube: (c) an overflow conduit coupled to the stationary intake tube above the rotor, the overflow conduit for directing molten metal out of the stationary intake tube: (f) a battery power source for activating the motor: (g) a control panel for operating the pump; and (g) an integral battery charger.

11 Claims, 4 Drawing Sheets

(56) References Cited

U.S. PATENT DOCUMENTS

| | | | | |
|---|---|---|---|---|
| 11,873,845 | B2 * | 1/2024 | Cooper | F04D 13/021 |
| 2008/0314548 | A1 * | 12/2008 | Cooper | C22B 21/0084 164/136 |
| 2009/0269217 | A1 | 10/2009 | Vijayakumar | |
| 2013/0101424 | A1 * | 4/2013 | Bright | F04D 1/14 416/223 R |
| 2016/0365738 | A1 | 12/2016 | Romer et al. | |
| 2018/0038373 | A1 | 2/2018 | Tetkoskie et al. | |
| 2019/0242390 | A1 | 8/2019 | Flaster | |
| 2019/0368494 | A1 | 12/2019 | Cooper | |

OTHER PUBLICATIONS

PCT Written Opinion—PCT/US2023/018270 dated Jul. 27, 2023; 5 pgs.

* cited by examiner

BATTERY OPERATED MOLTEN METAL PUMP

This application claims the benefit of U.S. Provisional Application No. 63/330,151 filed Apr. 12, 2022, the disclosure of which is herein incorporated by reference.

BACKGROUND

The present exemplary embodiment relates to a battery-operated molten metal pump. It finds particular application in conjunction with a rechargeable battery-operated drain-out pump and will be described with particular reference thereto. However, it is to be appreciated that the present exemplary embodiment is also amenable to other like applications.

Molten metals such as aluminum, tin, lead, and zinc are commonly used. Of course, to be placed in a molten state, the metal must be exposed to elevated temperatures. A variety of types of furnaces and other devices are used for this purpose, including smelting furnaces for aluminum production, induction furnaces for metal processing, and refractory furnaces for metal recycling. The following paragraphs describe several varied systems in which a molten metal exists.

Exemplary aluminum smelting pots consist of a rectangular steel box insulated with fire bricks along the bottom and the sides. Carbon blocks containing conductor rods are attached to the bottom brick lining, with the rods protruding from the cell structure. The sides of the cell are lined with carbon on top of the firebricks. Square anode blocks constructed form compressed petroleum, coke and coal tar are fixed to rods and suspended from two beam-like bus-bars attached to the cell structure, which as well as supplying electric current can lower or raise the anode blocks. Alumina is provided to the cell through an ore bin located above the cell and a portable fume extraction hood covers the cell. Aluminum is derived from the added aluminum within the melting pots via an electrolytic process.

As another example, induction furnaces employ electromagnetic energy to induce electrical currents within a charge of metal or metal alloy. The electrical resistance of the metal produces heat as a natural consequence of the induced currents flowing in the metal. The combination of applied electrical power and frequency can be chosen to induce sufficient heat within the metal to cause it to melt, providing a molten liquid which can be poured into molds or otherwise used to produce a wide variety of metal products. The basic elements of an induction furnace include an electromagnetic induction coil, a vessel having a lining of refractory material, and a support structure for the coil and vessel.

As a further example, metals may be melted in a reverberatory furnace. In a reverberatory furnace direct flame and radiation from hot refractory linings heat the metal. At its simplest, such a furnace is a steel box lined with alumina or other refractory brick having a flue at one end and a generally vertically lifting door at the other end closing a main entrance for the furnace through which a metal is directly charged into the furnace. The charge of molten metal may be introduced through the main entrance and lies in a shallow hearth having a relatively low roof so that flame passes across the surface of the charge. Conventional oil or gas burners are usually placed on either side of the furnace to heat the refractory lining and to melt the metal. The resulting molten metal is then transferred to a casting machine to produce metal ingot.

In the hot-dip galvanizing of an object, for example of iron, steel etc., the object is immersed in a bath of molten zinc, the iron and zinc forming alloys with one another. The molten zinc is typically housed in a refractory container during this process.

Each of these systems—and equipment not mentioned herein—is capable of failure. For example, within each of these systems a refractory lined vessel designed to withstand the extreme temperatures associated with molten metals may be employed. In operation, the interior surface of the refractory lining that contacts the molten metal can become sintered and brittle because of the extreme temperatures to which it is exposed. As the device is used repeatedly, the refractory expands and contracts in response to the heating and cooling cycles. Cracks form in the refractory, permitting small amounts of molten metal to migrate into the granular material. Failure can result in a dangerous situation where molten metal could escape containment.

Furthermore, each system requires the introduction of energy (e.g. heat or electricity) to keep the metal in a molten state. If the heating system were to fail (or power to the system is lost), the molten metal could solidify and ruin the system.

Transfer pumps are generally used to transfer molten metal from a vessel, such as the external well of a reverberatory furnace, to a different location such as a launder, ladle, or another furnace. Examples of transfer pumps are disclosed in U.S. Pat. Nos. 6,345,964 and 9,506,346, the disclosures of which are incorporated herein by reference. These pumps however are typically not suited to an emergency situation and cannot function if power to the facility is lost.

Accordingly, a means for rapid pump-out of molten metal would be advantageous should one of the failure situations described above, or a similar situation, be encountered (condition precedent to emergency pump-out). More particularly, an emergency pump-out device that operates from a self-contained power source is desirable in the case power to the overall facility is lost.

As used herein, the term "molten metal" means any metal or combination of metals in liquid form, such as aluminum, copper, iron, lead, tin, zinc, and alloys thereof.

BRIEF DESCRIPTION

Various details of the present disclosure are hereinafter summarized to provide a basic understanding. This summary is not an extensive overview of the disclosure and is neither intended to identify certain elements of the disclosure, nor to delineate scope thereof. Rather, the primary purpose of this summary is to present some concepts of the disclosure in a simplified form prior to the more detailed description that is presented hereinafter.

According to a first embodiment, a pump for transferring molten metal from a vessel is provided. The pump includes a stationary intake tube, the stationary intake tube comprises (i) a cavity having a diameter and being configured to direct molten metal upward through the cavity, (ii) a first end configured to be at least partially submerged in the molten metal in the vessel, and (iii) a second end. A DC motor is juxtaposed the second end. A rotatable drive shaft is positioned at least partially within the cavity of the stationary intake tube with a first end connected to the motor and a second end connected to a rotor positioned at least partially in the cavity at the first end of the stationary intake tube. A chamber is coupled to the stationary intake tube above the rotor for directing molten metal out of the stationary intake tube. A transportable cart containing a battery power source is provided for activating the motor. A control panel is provided for operating the pump. An integral battery charger is provided for maintaining a charge in the battery from an AC power source.

BRIEF DESCRIPTION OF THE DRAWINGS

The invention consists in the novel parts, construction, arrangements, combinations and improvements, shown and described. The accompanying drawings, which are incorporated in and constitute a part of the specification illustrate one embodiment of the invention and together with the description, serve to explain the principles of the invention.

DETAILED DESCRIPTION

The exemplary embodiment has been described with reference to the preferred embodiments. Obviously, modifications and alterations will occur to others upon reading and understanding this description. It is intended that the exemplary embodiment be construed as including all such modifications and alterations insofar as they come within the scope of the appended claims or the equivalents thereof.

The present pump provides a suitable emergency pump out apparatus. More particularly, the pump is battery-operated to allow use during a power failure. In addition, the pump is constructed of ceramic materials such that minimal preheating (e.g., 5 minutes) is required before insertion into molten metal.

Figure 1:
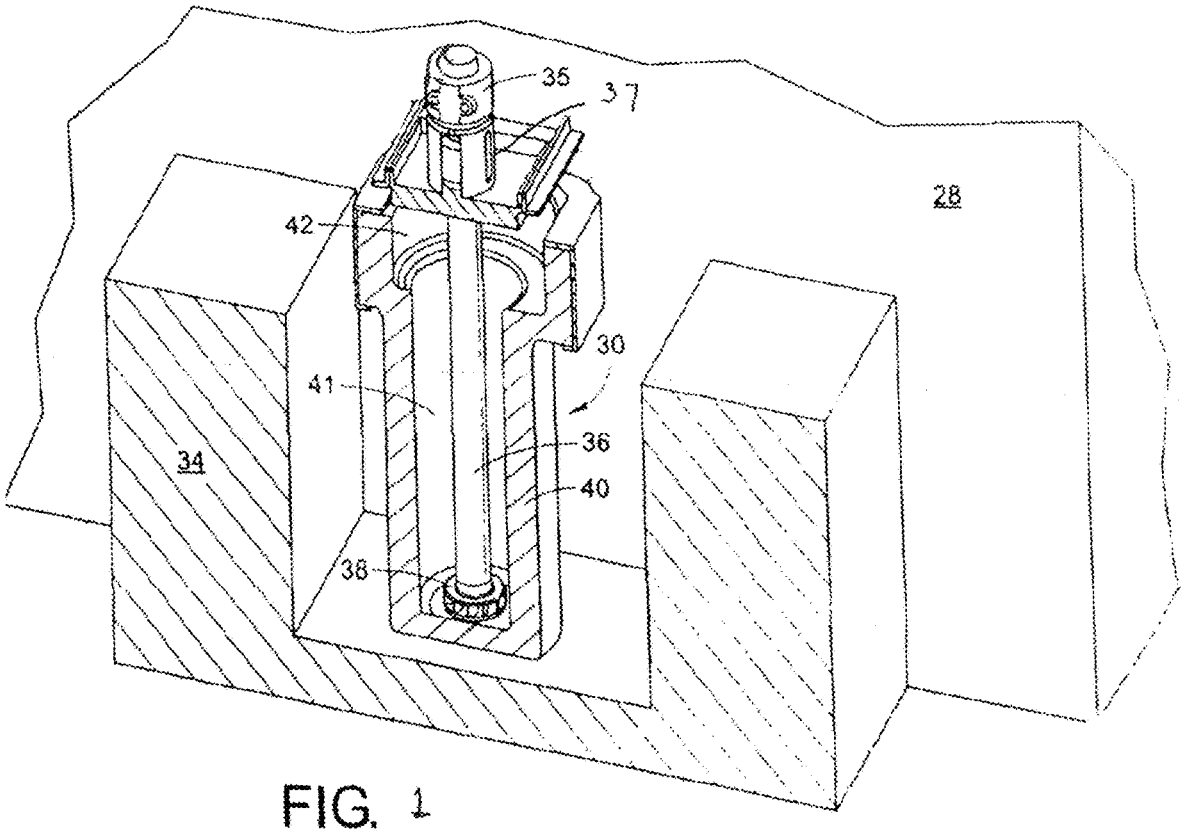
FIG. 1 is a perspective view of a molten metal pump.
Figure 2:
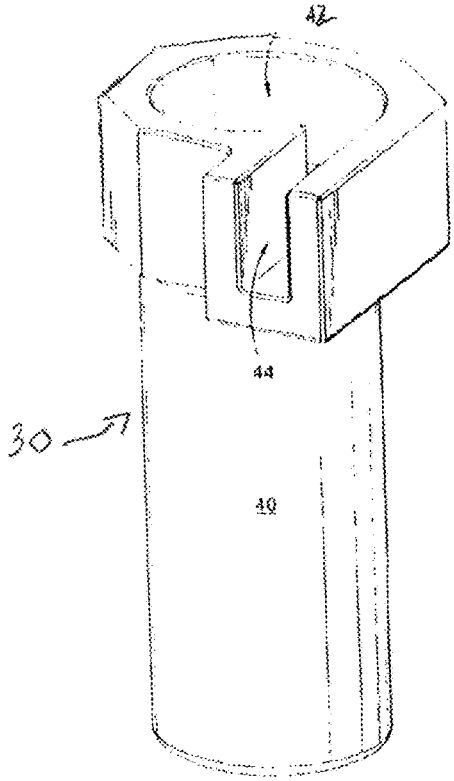
FIG. 2 is a perspective view of the stationary tube of the pump of FIG. 1.

Turning now to the Figures, where the purpose is to describe preferred embodiments of the invention and not to limit same. FIGS. 1 and 2 show an exemplary pump 30 for transferring molten metal from one or more vessels according to the present invention. The present invention may be utilized to transfer molten metal from one vessel such as the reverberatory furnace 28 to another vessel (such as a ladle) or any desired structure.

Pump 30 includes an intake tube 40, an overflow chamber 42, and a DC motor 35. The intake tube 40 is preferably fabricated from structural refractory materials such as ceramics that are resistant to disintegration by corrosive attack from the molten metal. In the embodiment depicted in FIGS. 1-2, intake tube 40 forms a cylinder.

The overflow chamber 42 can cause the molten metal to flow into a launder 44. Launder 44 may be part of the same structure as the intake tube extension 40, or it may be part of a separate structure.

The motor 35 may be coupled to the overflow chamber 42 and/or intake tube 40 in any suitable manner. A coupling between the motor 35 and the rotor shaft 36 can be surrounded by a housing 37 that includes a compressed air inlet. The compressed air inlet can include a quick connect fitting.

The pump 30 may be temporarily affixed to a support structure. For example, the pump 10 can be coupled to a horizontal pole in order to quickly position the pump as needed to transfer molten metal. Alternatively, the pump can be moved from one vessel to another vessel wherein each vessel is pre-fit with a pump receiving support structure.

The motor 35 is capable of driving the rotor 38 at a suitable speed to transfer molten metal from a vessel through the overflow chamber 42. The motor 35 is centered above the intake tube 40. Motor 35 includes a drives shaft coupled to rotor shaft 36. The rotor 36 is located inside chamber 41 of the intake tube 40.

The rotor 38 can be any suitable design. As the motor 35 turns the motor shaft, the motor shaft turns rotor shaft 36, which turns the rotor 38. As the rotor 38 rotates, it forces molten metal up the chamber 41 of intake tube 40 and into the overflow chamber 42. Overflow chamber 42 directs the molten metal into launder 44 where it flows to a receiving vessel such as a ladle.

Figure 3:
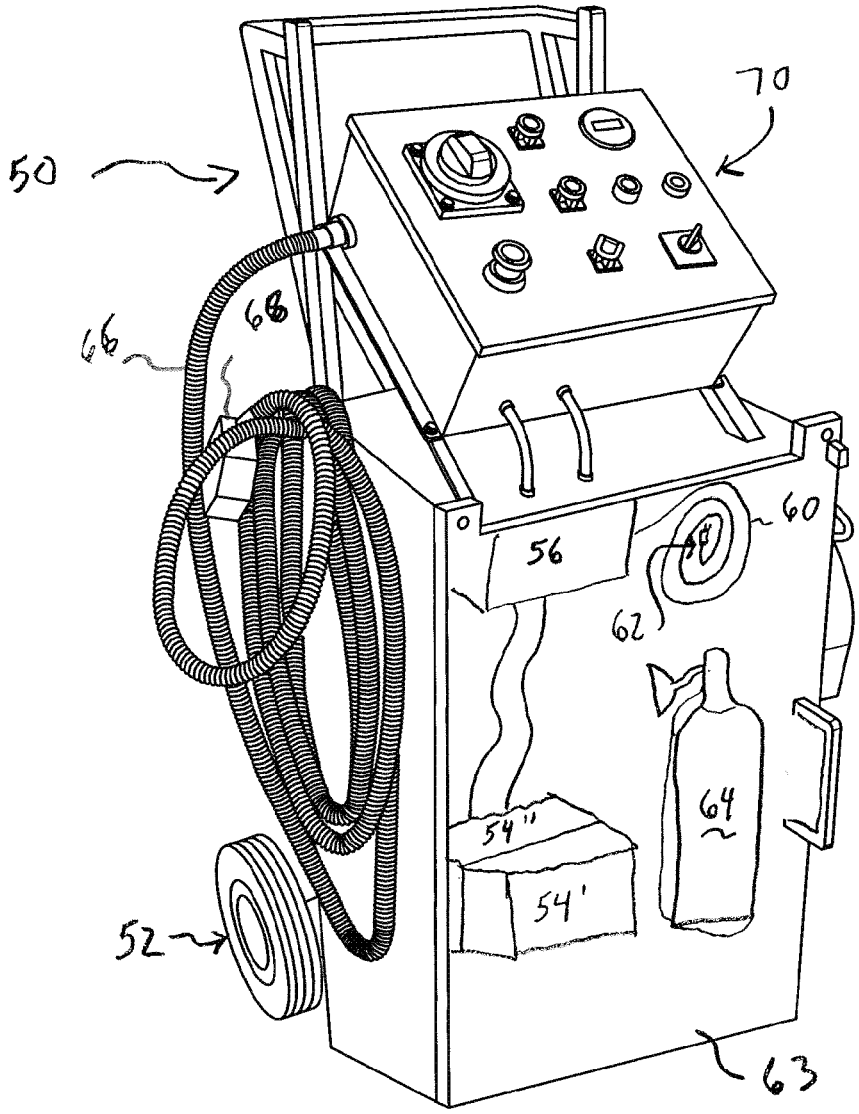
FIG. 3 is a perspective view of the power supply cart.

The pump can be associated with a power and operation cart 50 as shown in FIG. 3. The cart 50 can include wheels 52 to facilitate transport of the cart 50 to the location where the emergency pump-out is to be performed.

The cart 50 can include a battery or multiple batteries 54' and 54". The cart 50 can include a battery charger 56 wherein an AC power source can be used to charge the battery. The cart 50 can have an electrical cord 60 with a standard three-prong plug 62 to facilitate connection of the cart 50 to a traditional AC outlet, wherein battery charging can be performed. The cart 50 can include at least two distinct battery power sources allowing one battery power source to power the motor and the second battery power source to be in charge mode.

The cart 50 can further include a removable bottle 64 of compressed air to facilitate feeding air to the housing 37 when the facility has no power. Elements of the cart 50 disposed behind door 63 may be shown in phantom in FIG. 3.

The cart 50 can further include a power cord 66 having a quick connect electrical connection 68 to the pump motor 35. In some embodiments, the quick connect electrical connection 68 will be uniquely shaped to assure the DC motor 35 is only (with the exception of an optional hardwire connection to an AC source with converter) capable of electrical connection to the battery source of the cart 50.

Figure 4:
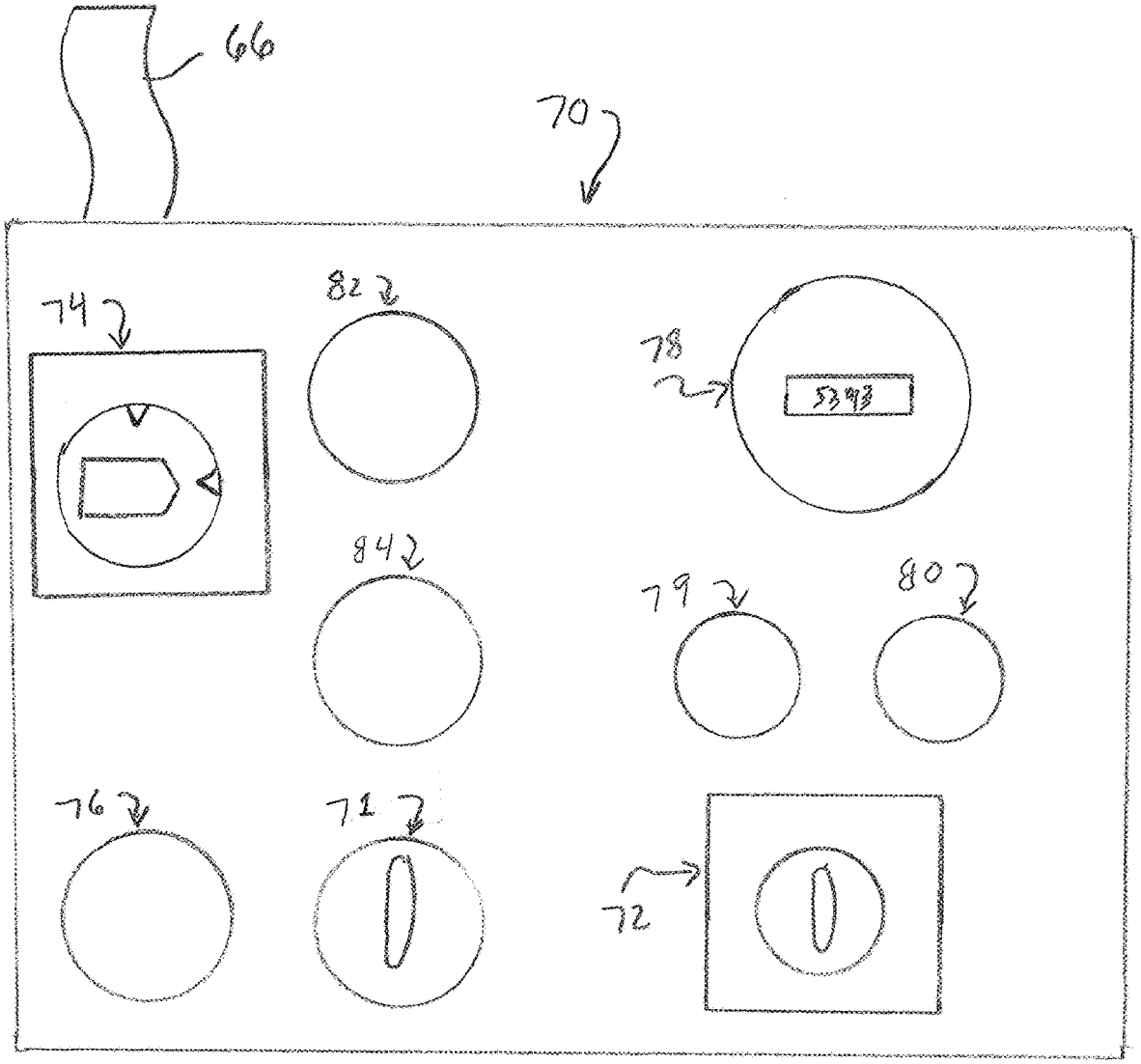
FIG. 4 is a front elevation view of a control panel for the molten metal pump of FIG. 1.

The cart 50 can include a control panel 70 as shown in FIG. 4. In one embodiment, the control panel 70 can also include on, off switch 71. The control panel 70 can also include a DC speed control dial 72. The motor may be variably controlled by dial 72 based, for example, on the level of the molten metal and/or the level of metal in the transfer vessel. In one embodiment, this variable control can include on, off, and a selectable range of RPMs between on and off. Accordingly, the control panel 70 can include a tachometer 78.

The control panel can include a charging mode control switch 74 that controls whether one or both batteries (if present) are being charged and/or which battery is being selected to operate the pump. The control panel can include an indicator 79 that displays whether the battery is fully charged or requires charging. The control panel can also include an emergency kill switch 76.

The control panel can further include a safety reset circuit that prevents unsafe operation in the event of component failure. For example, pump start-up can be disabled unless button 80 and on, off switch 71 are simultaneously triggered.

The control panel can also include selection buttons 82 and 84 for activating battery one or battery two.

Figure 5:
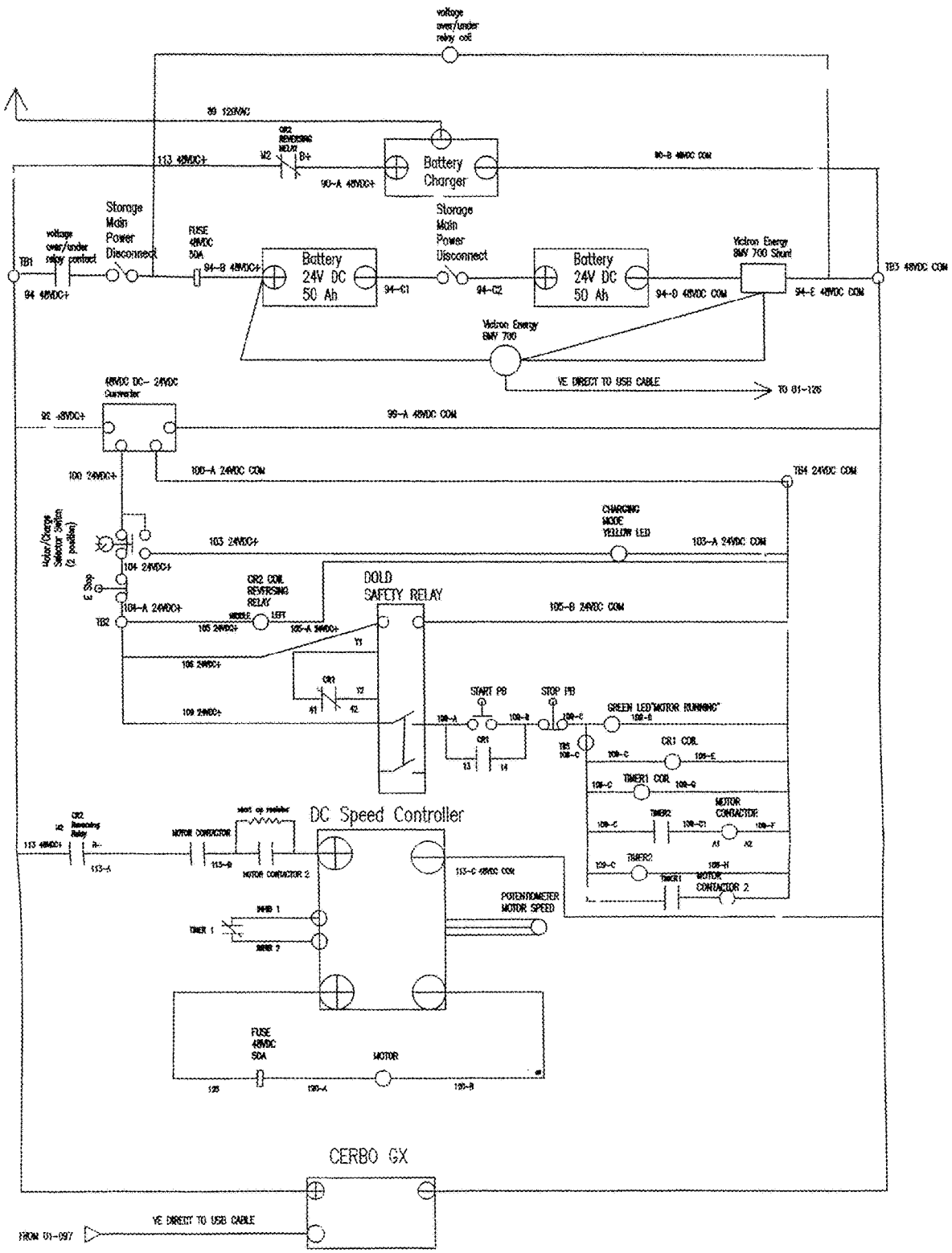
FIG. 5 is a schematic illustration of the control panel circuit.

Details of an exemplary control circuitry of the pump are shown in FIG. 5.

Having thus described different embodiments of the invention, other variations, and embodiments that do not depart from the spirit thereof will become apparent to those skilled in the art. The scope of the present invention is thus not limited to any particular embodiment, but is instead set forth in the appended claims and the legal equivalents thereof. Unless expressly stated in the written description or claims, the steps of any method recited in the claims may be performed in any order capable of yielding the desired product or result.

The invention claimed is:

1. A pump for transferring molten metal from a vessel, the system comprising:

(a) a stationary intake tube, the stationary intake tube comprising (i) a cavity having a diameter, and being configured to direct molten metal upward through the inner cavity, (ii) a first end configured to be at least partially submerged in the molten metal in the vessel, and (iii) a second end; (b) a DC motor juxtaposed the second end; (c) a rotatable drive shaft positioned at least partially within the cavity of the stationary intake tube, the rotatable drive shaft having a first end connected to the motor and a second end; (d) a rotor positioned at least partially in the cavity at the first end of the stationary intake tube; (e) an overflow conduit coupled to the stationary intake tube above the rotor, the overflow conduit for directing molten metal out of the stationary intake tube; and (f) a transportable cart including a battery power source for activating the motor, a control panel for operating the pump, and an integral battery charger, and a source of compressed air; said pump further including a housing surrounding a coupling between the motor and the rotatable drive shaft, said housing including a quick connect inlet for compressed air.

2. The pump of claim 1, wherein the control panel includes a DC speed control.

3. The pump of claim 1, wherein the control panel includes a charging mode.

4. The pump of claim 1, wherein the control panel includes an emergency kill switch.

5. The pump of claim 1, wherein the control panel includes a battery monitor.

6. The pump of claim 1, wherein the cart and the pump each include mating quick connect electrical connectors.

7. The pump of claim 1, wherein the control panel includes a safety circuit requiring engagement of multiple pump controls at pump start-up.

8. The pump of claim 1, wherein the cart includes at least two distinct battery power sources allowing one battery power source to power the motor and the second battery power source to be in charge mode.

9. The pump of claim 1 wherein the cart includes a cord for connection to an AC power source.

10. The pump of claim 9 wherein the cart includes wheels.

11. A method for emergency pump out of a molten metal from a vessel, said method comprises identifying a condition precedent which requires rapid removal of the molten metal from the vessel, and then introducing a pump into the molten metal, connecting a DC motor of said pump to a battery power source and a source of pressurized air, each located in a transportable cart, and rotating a shaft and impeller in combination with the DC motor, said impeller disposed within a pumping chamber and configured to direct molten metal into chamber and direct molten metal into a second vessel, and wherein said after said molten metal is removed from the vessel, said battery power source is connected to an AC power source for recharging.

* * * * *